US011164523B2

(12) United States Patent
Wang

(10) Patent No.: US 11,164,523 B2
(45) Date of Patent: Nov. 2, 2021

(54) COMPENSATION METHOD AND COMPENSATION APPARATUS FOR PIXEL CIRCUIT AND DISPLAY APPARATUS

(71) Applicant: BOE Technology Group Co., Ltd., Beijing (CN)

(72) Inventor: Ming Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/427,879

(22) Filed: May 31, 2019

(65) Prior Publication Data

US 2020/0043414 A1 Feb. 6, 2020

(30) Foreign Application Priority Data

Aug. 2, 2018 (CN) ..... 201810871077.4

(51) Int. Cl.
*G06F 1/00* (2006.01)
*G09G 3/3258* (2016.01)

(52) U.S. Cl.
CPC ..... *G09G 3/3258* (2013.01); *G09G 2320/043* (2013.01); *G09G 2330/028* (2013.01)

(58) Field of Classification Search
CPC .. G09G 3/3291; G09G 3/3283; G09G 3/3233; H01L 27/32
See application file for complete search history.

(56) References Cited

U.S. PATENT DOCUMENTS 6,956,398 B1 10/2005 Mair et al.
7,755,585 B2 7/2010 Kim
7,760,166 B2 7/2010 Uchino et al.
7,764,251 B2 7/2010 Yamashita et al.
8,836,690 B2 9/2014 Minami et al.
8,947,327 B2 2/2015 Yamashita et al.
9,177,506 B2 11/2015 Yamashita et al.
10,140,923 B2 11/2018 Wang
10,559,266 B2 2/2020 Feng
2005/0212554 A1 9/2005 Mair et al.
2007/0103406 A1 5/2007 Kim
2008/0030440 A1 2/2008 Uchino et al.
(Continued)

FOREIGN PATENT DOCUMENTS

CN 1446403 A 10/2003
CN 1947338 A 4/2007
(Continued)

OTHER PUBLICATIONS

First Office Action, including Search Report, for Chinese Patent Application No. 201810871077.4, dated Dec. 19, 2019, 20 pages.
(Continued)

*Primary Examiner* — Michael A Faragalla
(74) *Attorney, Agent, or Firm* — Westman, Champlin & Koehler, P.A.

(57) ABSTRACT

The present disclosure provides a compensation method and compensation apparatus for a pixel circuit, and a display apparatus. The compensation method for the pixel circuit includes: acquiring a threshold voltage of a driving transistor of the pixel circuit; comparing a source voltage of the driving transistor with the threshold voltage; and adjusting the source voltage of the driving transistor according to a comparison result.

16 Claims, 2 Drawing Sheets

(56) References Cited

U.S. PATENT DOCUMENTS

| | | | | |
|---|---|---|---|---|
| 2008/0198102 | A1 | 8/2008 | Yamashita et al. | |
| 2008/0231625 | A1 | 9/2008 | Minami et al. | |
| 2010/0141626 | A1* | 6/2010 | Tomida | G09G 3/3233 345/211 |
| 2010/0271354 | A1 | 10/2010 | Yamashita et al. | |
| 2014/0152723 | A1 | 6/2014 | Yamashita et al. | |
| 2014/0375701 | A1* | 12/2014 | Chaji | G09G 3/3283 345/690 |
| 2015/0097878 | A1 | 4/2015 | Yamashita et al. | |
| 2018/0233085 | A1* | 8/2018 | Wang | G09G 3/3266 |
| 2019/0114972 | A1 | 4/2019 | Feng | |
| 2020/0219446 | A1* | 7/2020 | Yoshida | G09G 3/3266 |

FOREIGN PATENT DOCUMENTS

| | | | |
|---|---|---|---|
| CN | 1964585 | A | 5/2007 |
| CN | 101140730 | A | 3/2008 |
| CN | 101251976 | A | 8/2008 |
| CN | 101271667 | A | 9/2008 |
| CN | 106548753 | A | 3/2017 |
| CN | 107134269 | A | 9/2017 |
| CN | 107705754 | A | 2/2018 |

OTHER PUBLICATIONS

Second Office Action, including Search Report, for Chinese Patent Application No. 201810871077.4, dated Aug. 12, 2020, 24 pages.

* cited by examiner

COMPENSATION METHOD AND COMPENSATION APPARATUS FOR PIXEL CIRCUIT AND DISPLAY APPARATUS

CROSS-REFERENCE TO RELATED APPLICATION(S)

This application claims priority to the Chinese Patent Application No. 201810871077.4, filed on Aug. 2, 2018, which is incorporated herein by reference in its entirety.

TECHNICAL FIELD

The present disclosure relates to the field of display technologies, and more particularly, to a compensation method and compensation apparatus for a pixel circuit, and a display apparatus.

BACKGROUND

Organic Light Emitting Diode (OLED) displays are one of hotspots in the current research field. Compared with Liquid Crystal Displays (LCDs), OLEDs have advantages such as low energy consumption, a low production cost, self-illumination, a wide viewing angle and a high response speed etc.

For an OLED display apparatus, in a pixel driving circuit, current flowing through an OLED is generally controlled by a driving transistor to control luminance of the OLED, and whether the OLED emits light is controlled by controlling turn-on and turn-off of the driving transistor. When the OLED stops emitting light, it may not be guaranteed that the driving transistor is completely turned off without loss due to factors such as a manufacturing process, a condition, usage time etc., which results in electric leakage of a display after the display stops displaying since the driving transistor is not completely turned off, and therefore a light leakage phenomenon occurs.

SUMMARY

Embodiments of the present disclosure provide a compensation method and compensation apparatus for a pixel circuit and a display apparatus.

According to an aspect of the present disclosure, there is provided a compensation method for a pixel circuit, the compensation method comprising:

acquiring a threshold voltage of a driving transistor of the pixel circuit;

comparing a source voltage of the driving transistor with the threshold voltage; and adjusting the source voltage of the driving transistor according to a comparison result.

In an example, adjusting the source voltage of the driving transistor according to a comparison result comprises:

increasing the source voltage of the driving transistor in response to an inversion of the source voltage of the driving transistor being greater than the threshold voltage.

In an example, increasing the source voltage of the driving transistor comprises:

generating a target source voltage by adding a set value to a value of a current source voltage of the driving transistor; and inputting the target source voltage to a source of the driving transistor.

In an example, the current source voltage is a source voltage of the driving transistor at which the threshold voltage of the driving transistor is acquired.

In an example, the target source voltage is greater than or equal to 0V.

In an example, the set value is a fixed value.

In an example, the set value is an integral multiple of 0.5 or an integral multiple of 0.2.

In an example, the set value is greater than an absolute value of a sum of the threshold voltage and the current source voltage.

In an example, a light emitting unit in the pixel circuit which is connected to the driving transistor is controlled not to emit light during the acquisition of the threshold voltage of the driving transistor.

According to another aspect of the present disclosure, there is provided a compensation apparatus for a pixel circuit, comprising:

a sensing circuit configured to acquire a threshold voltage of a driving transistor of the pixel circuit; and a controller configured to compare a source voltage of the driving transistor with the threshold voltage, and adjust the source voltage of the driving transistor according to a comparison result.

In an example, the controller is configured to adjust the source voltage of the driving transistor according to the comparison result by:

increasing the source voltage of the driving transistor in response to an inversion of the source voltage of the driving transistor being greater than the threshold voltage.

In an example, the controller is configured to increase the source voltage of the driving transistor by:

generating a target source voltage by adding a set value to a value of a current source voltage of the driving transistor; and inputting the target source voltage to a source of the driving transistor.

In an example, the current source voltage is a source voltage of the driving transistor at which the threshold voltage of the driving transistor is acquired.

In an example, the target source voltage is greater than or equal to 0V.

In an example, the set value is a fixed value.

In an example, the set value is an integral multiple of 0.5 or an integral multiple of 0.2.

In an example, the set value is greater than an absolute value of a sum of the threshold voltage and the current source voltage.

In an example, the sensing circuit is configured to control a light emitting unit in the pixel circuit which is connected to the driving transistor not to emit light during the acquisition of the threshold voltage of the driving transistor.

In an example, the sensing circuit comprises a sensing transistor and a sensing capacitor, wherein the sensing transistor has a gate connected to receive a control signal, a first electrode connected to a source of the driving transistor, and a second electrode connected to a first terminal of the sensing capacitor, and a second terminal of the sensing capacitor is grounded.

According to yet another aspect of the present disclosure, there is provided a display apparatus, comprising the compensation apparatus for the pixel driving circuit described above.

BRIEF DESCRIPTION OF THE ACCOMPANYING DRAWINGS

The embodiments of the present disclosure will be described in detail below with reference to the accompanying drawings.

DETAILED DESCRIPTION

The technical solutions according to the embodiments of the present disclosure will be clearly and completely described below in conjunction with the accompanying drawings in the embodiments of the present disclosure. The embodiments described are only a part of the embodiments of the present disclosure, instead of all the embodiments. All other embodiments obtained by those of ordinary skill in the art based on the embodiments of the present disclosure without any creative work fall within the protection scope of the present disclosure.

In order to prevent electric leakage of a driving transistor in a pixel circuit, a fixed voltage is input to a source of the driving transistor, so that $V_{gs}<V_{th}$, wherein $V_{th}$ is a threshold voltage of the driving transistor, and a gate-source voltage $V_{gs}$ of the driving transistor is equal to a gate voltage $V_g$ of the driving transistor minus a source voltage $V_s$ of the driving transistor. In this way, it is ensured that the driving transistor is turned off. However, after the fixed voltage is input to the source of the driving transistor, the driving transistor may continuously be negatively biased by the fixed voltage input to the source, which results in an increase in a negative drift of the driving transistor, that is, the threshold voltage $V_{th}$ is negatively increased (from, for example, −0.4V to −0.5V), and thereby, it cannot be ensured that the driving transistor always satisfies $V_{gs}<V_{th}$. However, if a large fixed voltage nV is input to the source of the driving transistor, since a voltage output by a driving Integrated Circuit (IC) for driving the pixel circuit has an upper limit hV, the fixed voltage nV may cause a data voltage range of an output of the IC to be 0~(h−n)V, which reduces the data voltage range of the output of the IC. Further, since the voltage at the source of the driving transistor is large, a negative bias voltage of the driving transistor is increased, and the threshold voltage $V_{th}$ is negatively increased at a higher speed, which affects the lifetime of the product.

The embodiments of the present disclosure provide a compensation method and compensation apparatus for a pixel circuit and a display apparatus, which acquire a threshold voltage of a driving transistor of the pixel circuit and adjust a source voltage of the driving transistor according to a comparison result of the source voltage and the threshold voltage of the driving transistor. In this way, intelligent adjustment of the source voltage of the driving transistor is realized, so as to prevent electric leakage of the driving transistor while avoiding the above problem caused by the excessive source voltage of the driving transistor.

Figure 1:
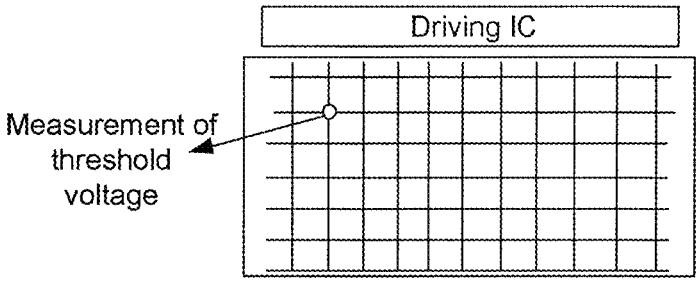
FIG. 1 is a schematic diagram of acquiring a threshold voltage from a pixel circuit of a display apparatus according to an embodiment of the present disclosure.

FIG. 1 is a schematic diagram of acquiring a threshold voltage from a pixel circuit of a display apparatus according to an embodiment of the present disclosure. As shown in FIG. 1, the display apparatus comprises pixel units arranged in an array, wherein each of the pixel units is represented by an intersection of respective grid lines in FIG. 1. Each of the pixel units may comprise a pixel circuit, and a threshold voltage of a driving transistor in each pixel circuit may be acquired from the pixel circuit, as indicated by an arrow in FIG. 1. The display apparatus in FIG. 1 may be an Organic Light Emitting Diode (OLED) based display apparatus. In some embodiments, in order not to affect display, a threshold voltage $V_{th}$ of the driving transistor may be detected before the OLED display apparatus is powered off, and compensation is performed according to the detected threshold voltage $V_{th}$.

Figure 2:
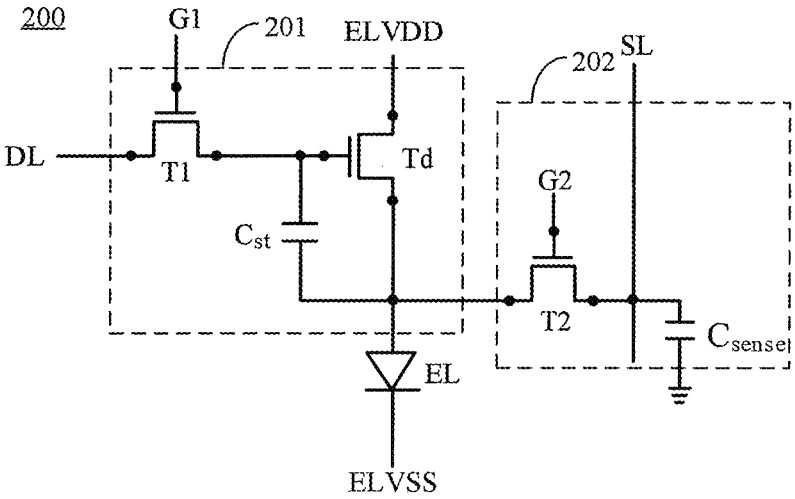
FIG. 2 is a schematic structural diagram of a pixel circuit according to an embodiment of the present disclosure.

FIG. 2 is a schematic structural diagram of a pixel circuit according to an embodiment of the present disclosure.

As shown in FIG. 2, the pixel circuit 200 comprises a pixel driving circuit 201 and a light emitting element EL. The pixel driving circuit 201 comprises a first transistor T1, a driving transistor Td, and a capacitor $C_{st}$, wherein the driving transistor Td is used to generate driving current for causing the light emitting unit EL to emit light. The transistor T1 has a gate connected to a first gate line G1 to receive a first control signal, a first electrode connected to a data line DL to receive a data voltage (hereinafter also referred to as driving data), and a second electrode connected to a gate of the transistor Td. The driving transistor Td has the gate connected to a second gate line to receive a second control signal, a source connected to an input terminal of the light emitting element EL to provide a driving signal for causing the light emitting element EL to emit light, and a drain connected to a power signal terminal ELVDD. The capacitor $C_{st}$ has a first terminal connected to the gate of the driving transistor Td, and a second terminal connected to the source of the driving transistor Td. The light emitting element EL has an input terminal connected to the source of the driving transistor Td to receive the driving signal for causing the light emitting element EL to emit light, and an output terminal connected to a reference signal terminal ELVSS.

The source of the driving transistor Td may be connected to a sensing circuit 202 for sensing a threshold voltage of the driving transistor Td. In FIG. 2, the sensing circuit comprises a second transistor T2 (a sensing transistor) and a capacitor $C_{sense}$ (a sensing capacitor). The second transistor T2 has a gate connected to receive a second control signal G2, a first electrode connected to the source of the driving transistor Td, and a second electrode connected to a first terminal of the capacitor $C_{sense}$, and a second terminal of the capacitor $C_{sense}$ is grounded. A node between the transistor T2 and the capacitor may be connected to a sensing signal line SL to output a sensing signal, which is used to calculate the threshold voltage of the driving transistor Td.

The threshold voltage $V_{th}$ of the driving transistor Td may be read, for example, each time before the OLED display apparatus is powered off (for example, after the OLED display apparatus receives a power-off instruction and before the OLED display apparatus is powered off). For example, a data voltage $V_d$ may be applied to the data line DL, a sensing voltage $V_{sl}$ may be acquired from the sensing signal line SL, and the threshold voltage may be calculated based on the data voltage $V_d$ and the sensing voltage $V_{sl}$. In some embodiments, analog-to-digital conversion may be performed by an Analog-to-digital converter (ADC) on a signal on the sensing signal line SL to obtain $V_{sl}$. The threshold voltage of the driving transistor Td is calculated by the following formula: $V_{th}=V_d-V_{sl}-V_s$, where $V_s$ is a source voltage of the driving transistor Td, and $V_d$ is the data voltage (driving data) input to the data line DL.

Figure 3:
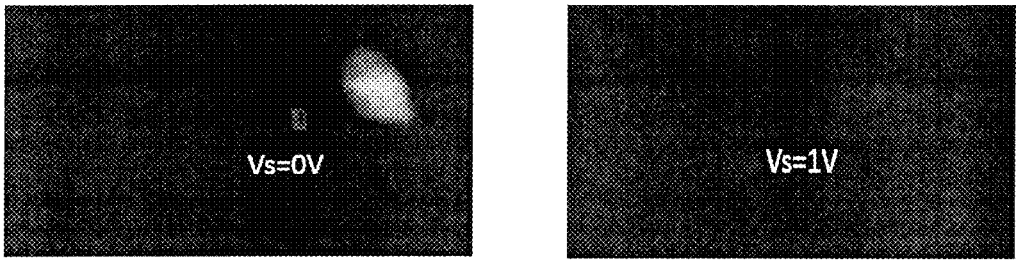
FIG. 3 is a comparison diagram of display effects before and after compensation is performed according to an embodiment of the present disclosure.

The threshold voltage $V_{th}$ is usually in a range of 0-1V, and an excessive threshold voltage $V_{th}$ may increase power consumption of the product and reduce a compensation space. When the threshold voltage $V_{th}$<0V, it may result in that electric leakage of the driving transistor Td occurs when the driving transistor Td is in a turn-off state, and thereby a light leakage phenomenon occurs. In order to improve the light leakage phenomenon, compensation may be performed by controlling the source voltage of the driving transistor Td. For example, the source voltage $V_s$=1V is provided, so that even if the threshold voltage $V_{th}$=−0.5V, it may be ensured that the gate-source voltage $V_{gs}$=−1V, and thereby it may be ensured that $V_{gs}<V_{th}$. In this case, the driving transistor Td may not be turned on, i.e. $0-V_s<V_{th}$ is satisfied, so that electric leakage of the driving transistor Td may not occur. As shown in FIG. 3, in a case where the threshold voltage $V_{th}$=−0.5V, when the source voltage $V_s$=0V, electric leakage of the driving transistor Td occurs when the driving transistor Td is in a turn-off state, and thereby a light leakage phenomenon occurs. When the source voltage $V_s$=1V, electric leakage of the driving transistor Td may not occur when the driving transistor Td is in a turn-off state, and thereby there is no light leakage phenomenon. As the usage time increases, a negative drift of the driving transistor Td gradually increases, and the threshold voltage $V_{th}$ changes accordingly. The source voltage $V_s$ needs to be large enough to ensure that electric leakage of the driving transistor Td may not occur. However, as discussed above, an excessive source voltage $V_s$ may cause problems such as a reduced data voltage range and aging etc.

Figure 4:
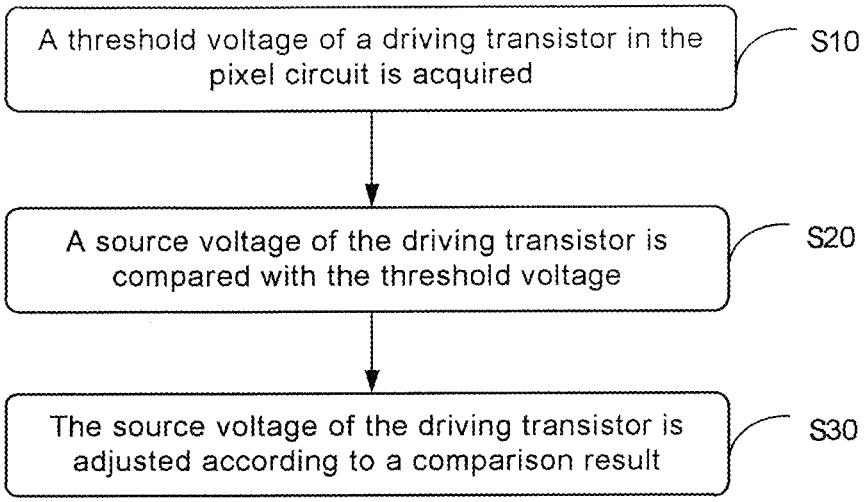
FIG. 4 is a flowchart of a compensation method for a pixel circuit according to an embodiment of the present disclosure.

A compensation method for a pixel circuit according to an embodiment of the present disclosure will be described below with reference to FIG. 4. The compensation method according to the embodiment of the present disclosure will be described below by taking the pixel circuit described with reference to FIG. 2 as an example. However, it should be apparent to those skilled in the art that the embodiments of the present disclosure are not limited thereto, and the compensation method according to the embodiment of the present disclosure may be applied to pixel circuits having any other structures, as long as the pixel circuits each have a driving transistor for generating driving current.

In step S10, a threshold voltage of a driving transistor in the pixel circuit is acquired. For example, the threshold voltage $V_{th}$ of the driving transistor Td in the pixel circuit 200 described above may be acquired. The threshold voltage $V_{th}$ may be a threshold voltage $V_{th}$ of the driving transistor Td under the driving of the driving data $V_d$.

For example, in conjunction with the pixel driving circuit having a 3T2C structure in FIG. 2 (however, the present disclosure is not limited to the pixel driving circuit, and the method for eliminating electric leakage of the driving transistor according to the present disclosure is applicable to any pixel driving circuit), a process of acquiring the threshold voltage $V_{th}$ comprises an initialization phase and a charging phase.

In the initialization phase, a first control signal and a second control signal (also referred to as scanning signals) are input to the first gate line G1 and the second gate line G2 respectively, and the first transistor T1 and the second transistor T2 are turned on; the driving data $V_d$ (which may, for example, be of 3V) is input to the gate of the driving transistor Td through the data line DL, that is, $V_g=V_d$=3V; and a reset voltage $V_0$ (which may, for example, be of 0V) is input to the source of the driving transistor Td through the sensing signal line SL, that is, $V_s=V_0$, to reset the source of the driving transistor Td.

In the charging phase, the first transistor T1 and the second transistor T2 remain to be turned on, the driving transistor Td is turned on, and current passes through the second transistor T2 to charge the capacitor $C_{sense}$ of the sensing signal line SL. Based thereon, according to a charging voltage of the capacitor $C_{sense}$, the threshold voltage ($V_{th}=V_d-V_{sl}-V_s$) of the driving transistor Td may be acquired in combination with the gate voltage $V_g$ (that is, the driving data $V_d$) of the driving transistor Td according to a charging curve of the capacitor $C_{sense}$ and the voltage $V_{sl}$ on the sensing signal line SL.

It should be understood here that in acquiring the threshold voltage, the reset voltage $V_0$ input to the source of the driving transistor Td may have a fixed value which is not automatically adjusted as the usage time elapses.

In some embodiments, when acquiring the threshold voltage $V_{th}$ of the driving transistor Td, a light emitting unit connected to the driving transistor Td does not emit light. For example, a sufficiently small driving voltage (driving data) $V_d$ may be applied during the acquisition of the threshold voltage $V_{th}$ of the driving transistor Td, so that the light emitting unit does not emit light under the driving of the driving voltage. In this way, during the acquisition of the threshold voltage $V_{th}$, the driving data $V_d$ is not large enough to drive the light emitting unit in the pixel circuit to emit light, and the OLED device is in a black screen state, thereby not affecting the display effect.

In step S20, a source voltage of the driving transistor is compared with the threshold voltage.

In step S30, the source voltage of the driving transistor is adjusted according to a comparison result.

For example, the source voltage $V_s$ of the driving transistor Td may be increased in response to an inversion of the source voltage $V_s$ of the driving transistor Td being greater than the threshold voltage $V_{th}$.

For example, in a case of $-V_s>V_{th}$, the source voltage $V_s$ of the driving transistor Td may be increased; otherwise, the source voltage $V_s$ of the driving transistor Td is not changed. Since the gate voltage $V_g$ of the driving transistor Td in a turn-off state is equal to 0, the gate-source voltage $V_{gs}=0-V_s=-V_s$, and therefore, $-V_s>V_{th}$, that is, $V_{gs}>V_{th}$. In this case, electric leakage of the driving transistor Td may occur, and the source voltage $V_s$ needs to be increased to reduce $V_{gs}$, until $V_{gs}<V_{th}$, that is, $-V_s<V_{th}$, to ensure that the electric leakage of the driving transistor Td does not occur.

Here, the source voltage $V_s$ is increased on the basis of the original source voltage $V_s$, and the increased source voltage $V_s$ is greater than the source voltage $V_s$ before the adjustment. For example, when the threshold voltage $V_{th}$ of the driving transistor Td is acquired, the source voltage $V_s$=0V, and if $-V_s>V_{th}$, the source voltage $V_s$ may be increased, for example, the increased source voltage $V_s$=1V.

The source voltage $V_s$ may be controlled by, for example, an IC. For example, the source voltage $V_s$ may be adjusted by program control. The amount by which the source voltage $V_s$ of the driving transistor Td is increased is not specifically limited in the embodiment of the present disclosure. As long as the source voltage $V_s$ is increased, a voltage difference between $-V_s$ and $V_{th}$ may be reduced, which reduces leaked electric quantity and improves the light leakage phenomenon.

Regarding a comparison between the threshold voltage $V_{th}$ and the inversion of the source voltage $V_s$, by way of example, if the threshold voltage $V_{th}$=−0.4V, and the inversion $-V_s$ of the source voltage is equal to −0.5V, $V_{th}>-V_s$; and if the threshold voltage $V_{th}$=1.2V, and the inversion $-V_s$ of the source voltage is equal to −1.0V, $V_{th}<-V_s$.

With the method for eliminating the leakage current of the driving transistor according to the embodiment of the present disclosure, it is determined whether it is necessary to adjust the source voltage $V_s$ of the driving transistor Td according to a comparison result obtained by comparing the inversion of the source voltage $V_s$ of the driving transistor Td with the threshold voltage $V_{th}$, which realizes intelligent control of the source voltage, thereby avoiding the above problems caused by the excessive source voltage. For example, in a case of $-V_s \leq V_{th}$, the source voltage $V_s$ of the driving transistor Td may not be changed; and in a case of $-V_s > V_{th}$, the source voltage $V_s$ of the driving transistor Td may be increased. In this way, the source voltage $V_s$ currently required to be provided is intelligently identified by monitoring the threshold voltage $V_{th}$ in real time, so as to determine whether to adjust the source voltage $V_s$, thereby mitigating the problem of leakage current on the driving transistor Td. Based thereon, by controlling the degree of increase in the source voltage $V_s$, it may be ensured that the driving transistor Td is under a desired negative bias for a long time, and a too small output range of the data voltage is prevented, thereby prolonging the lifetime of the product.

In some embodiments, step S30 may comprise steps S21 and S22.

In step S21, a set value is added to a current source voltage $V_{s0}$ to generate a target source voltage $V_{s1}$.

Here, the current source voltage $V_{s0}$ is a source voltage $V_s$ of the driving transistor Td at which the threshold voltage $V_{th}$ of the driving transistor Td is acquired.

For example, if the threshold voltage $V_{th}$ which is acquired with reference to the current source voltage $V_{s0}$ satisfies $V_{th} \geq V_{s0}$, the current source voltage $V_{s0}$ may not be changed, and if the threshold voltage $V_{th}$ which is measured with reference to the current source voltage $V_{s0}$ satisfies $V_{th} < -V_{s0}$, the current source voltage $V_{s0}$ may be changed, for example, a target source voltage $V_{s1}$ may be generated by adding a set value to a value of the current source voltage $V_{s0}$, that is, $V_{s1} = V_{s0}$+set value.

Here, the set value may be a fixed value or a variable value, and may be an integer or a decimal, which may be selected as needed. The set value is a positive number. For example, in a case of $V_{s0}$=0.5V, if the set value is 0.5V, $V_{s1}$=1V may be obtained by the above calculation.

In step S22, the target source voltage $V_{s1}$ is input to the source of the driving transistor Td.

In this way, in the embodiment of the present disclosure, intelligent adjustment of the source voltage $V_{s1}$ of the driving transistor Td is realized.

For example, description will be made by taking the pixel circuit shown in FIG. 2 as an example. In the initialization phase, scanning signals are input to the first gate line G1 and the second gate line G2, and the first transistor T1 and the second transistor T2 are turned on; the driving data $V_d$ is input to the gate of the driving transistor Td through the data line DL; and the target source voltage $V_{s1}$ is input to the source of the driving transistor Td through the sensing signal line SL to reset the source of the driving transistor Td. Compared with a conventional technical solution in which the same voltage is input to the source of the driving transistor Td in various initialization phases, in the present disclosure, the source voltage is adjusted by comparing the threshold voltage $V_{th}$ of the driving transistor Td with the source voltage, which realizes intelligent adjustment of the source voltage while preventing electric leakage of the driving transistor.

In some embodiments, in order to avoid a positive drift of the driving transistor Td, the target source voltage $V_{s1}$ is not less than 0V when a voltage is input to the source of the driving transistor Td. That is, the smallest one of voltages input to the source of the driving transistor Td has a value greater than or equal to 0V.

In some embodiments, the set value which is added each time to the current source voltage $V_{s0}$ may be taken as a fixed value. For example, the set value may be an integral multiple of 0.5, may be an integral multiple of 0.2, or may be an integral multiple of 0.1, or may of course be an integral multiple of other values. If it is necessary to increase the source voltage $V_s$ of the driving transistor Td according to the comparison result, the target source voltage $V_{s1}$ is obtained by adding a fixed value to the current source voltage $V_{s0}$. In this way, the computational complexity may be reduced.

In some embodiments, the set value is greater than an absolute value of a sum of the threshold voltage $V_{th}$ and the current source voltage $V_{s0}$, i.e., the set value>=$V_{th}+V_{s0}$=. In this way, the accuracy of adjustment of the source voltage $V_s$ may be improved while preventing leakage current. In some embodiments, the source voltage $V_s$ of the driving transistor Td may even be minimized.

In a case where the threshold voltage $V_{th}$>0V and the current source voltage $V_{s0} \geq 0$V, the threshold voltage $V_{th}$ is greater than an inversion of the current source voltage $V_{s0}$, and the current source voltage $V_{s0}$ may not be changed.

In a case where the threshold voltage $V_{th}$<0V and the current source voltage $V_{s0} \geq 0$V, if $V_{th} < -V_{s0}$, it needs to enable the set value>=$V_{th}+V_{s0}$=, so that $V_{th} > -V_{s1}$, that is, $V_{th} > -(V_{s0}$+set value).

For example, if the threshold voltage $V_{th}$=−0.4V, and the inversion $-V_{s0}$ of the current source voltage $V_{s0}$ is equal to −0.3V, $V_{th} < -V_{s0}$. =$V_{th}+V_{s0}$==−0.4+0.31=0.1V. If the set value is 0.11, the target source voltage $V_{s1}$=0.3+0.11=0.41V, that is, $V_{th} > -V_{s1}$, which may prevent the leakage current of the driving transistor Td.

The embodiments of the present disclosure further provide a compensation apparatus for a pixel circuit, which will be described below with reference to FIG. 5.

Figure 5:
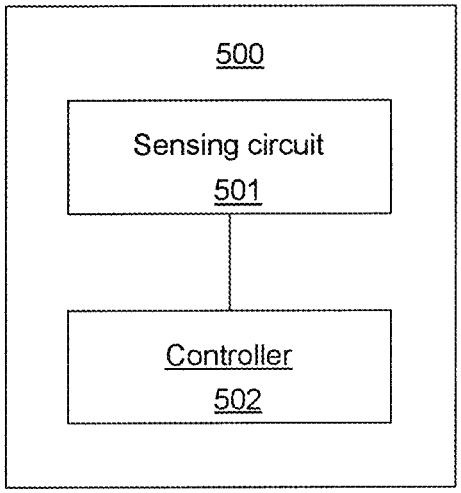
FIG. 5 is a block diagram of a compensation apparatus for a pixel circuit according to an embodiment of the present disclosure.

FIG. 5 is a block diagram of a compensation apparatus for a pixel circuit according to an embodiment of the present disclosure. The compensation apparatus according to the embodiment of the present disclosure will be described below by taking the pixel circuit described above with reference to FIG. 2 as an example. However, it should be understood by those skilled in the art that the compensation apparatus according to the embodiment of the present disclosure is not limited to the above pixel circuit, and may also be applied to pixel circuits having other structures.

As shown in FIG. 5, the compensation apparatus 500 comprises a sensing circuit 501 and a controller 502.

The sensing circuit 501 may be implemented by the sensing circuit 202 described above. The sensing circuit 501 is configured to acquire a threshold voltage $V_{th}$ of a driving transistor Td, wherein the threshold voltage $V_{th}$ is a threshold voltage $V_{th}$ of the driving transistor Td under the driving of driving data $V_d$. As shown in FIG. 2, the sensing circuit 501 may comprise a sensing transistor (i.e., a second transistor T2) and a sensing capacitor $C_{sense}$. In some embodiments, the sensing circuit 501 may further comprise an ADC etc.

The controller 502 may perform steps S20 and S30 in the above compensation method. For example, the controller 502 may compare a source voltage of the driving transistor with the threshold voltage and adjust the source voltage of the driving transistor according to a comparison result. For example, the controller may obtain an analog-to-digital converted sensing voltage $V_{sl}$ from the sensing circuit 501, calculate the threshold voltage $V_{th}$ of the driving transistor Td according to a calculation formula of $V_{th}=V_d-V_{sl}-V_s$, compare the threshold voltage $V_{th}$ with the source voltage $V_s$, and increase the source voltage $V_s$ of the driving transistor Td in response to an inversion of the source voltage $V_s$ of the driving transistor Td being greater than the threshold voltage $V_{th}$.

In some embodiments, the controller may generate a target source voltage $V_{s1}$ by adding a set value to a value of a current source voltage $V_{s0}$; and input the target source voltage $V_{s1}$ to a source of the driving transistor Td. The current source voltage $V_{s0}$ is a source voltage of the driving transistor Td when the threshold voltage $V_{th}$ of the driving transistor Td is acquired.

The above controller may be implemented in a variety of ways. For example, the controller may comprise a memory and a processor, wherein the memory has stored thereon a computer program executable on the processor for executing the computer program described above to implement the operations described above with reference to steps S20 and S30, e.g. to increase the source voltage $V_s$ of the driving transistor Td for example in a case where the inversion of the source voltages $V_s$ of the driving transistor is greater than the threshold voltage $V_{th}$.

For example, the above memory may comprise a high-speed random access memory, and may also comprise a non-volatile memory such as a magnetic disk storage device, a flash memory device, or other volatile solid-state storage devices etc. For example, the above processor may be a Central Processing Unit (CPU), a general-purpose processor, a Digital Signal Processor (DSP), an Application-Specific Integrated Circuit (ASIC), a Field Programmable Gate Array (FPGA) or other programmable logic devices, transistor logic devices, hardware components, or any combination thereof. The processor may implement or perform various illustrative logical blocks, modules and circuits described in connection with content disclosed in the present application. The processor may also be a combination of processors which perform computing functions, for example, a combination of one or more microprocessors, a combination of a DSP and a microprocessor, etc. Of course, the above control module may also implement the above adjustment of the source voltage $V_s$ in a form of hardware.

The sensing circuit is configured to acquire the threshold voltage $V_{th}$ of the driving transistor Td, and may comprise other elements or circuits, such as an adder, a divider, a multiplier, a comparator, etc., in addition to the second transistor T2 and the sensing capacitor $C_{sense}$. An appropriate structure of the sensing circuit may be selected according to a specific acquisition method.

The controller is configured to obtain the target source voltage $V_{s1}$, and may also comprise an adder, a divider, a multiplier, a comparator, etc. An appropriate structure of the controller may be selected according to a specific acquisition manner.

The embodiments of the present disclosure further provide a display apparatus comprising the above compensation apparatus for the pixel circuit. Since the structure and the beneficial effects of the compensation apparatus have been described in detail in the above embodiments, they will not be described herein again.

In the embodiments of the present disclosure, the display apparatus may further comprise an OLED display panel, which may, for example, be applied to any product or component having a display function, such as a display, a television, a digital photo frame, a mobile phone, or a tablet computer etc.

It may be understood by those of ordinary skill in the art that all or a part of steps which implement the above method embodiments may be completed by a program instructing related hardware. The above program may be stored in a computer readable storage medium, and when the program is executed, the above steps comprising the above method embodiments are performed. The above storage medium comprises a medium which may store program codes, such as a Read Only Memory (ROM), a Random Access Memory (RAM), a magnetic disk, or an optical disk etc.

The above description is merely specific embodiments of the present disclosure, and the protection scope of the present disclosure is not limited thereto. Variations or substitutions which are easily reached by any person skilled in the art within the technical scope disclosed in the present disclosure is intended to be covered by the protection scope of the present disclosure. Therefore, the protection scope of the present disclosure should be determined by the protection scope of the claims.

I claim:

1. A compensation method for a pixel circuit, the compensation method comprising:

calculating a current threshold voltage $V^{th}$ of a driving transistor of the pixel circuit according to a current source voltage $V^s$ of the driving transistor and a data voltage applied to a gate of the driving transistor;

comparing the current source voltage $V^s$ of the driving transistor with the current threshold voltage $V^{th}$; and adjusting the current source voltage $V^s$ of the driving transistor according to a comparison result, wherein the current source voltage $V^s$ is a positive number, and the current threshold voltage $V^{th}$ is a negative number; and the adjusting the current source voltage $V^s$ of the driving transistor according to a comparison result comprises:

increasing the current source voltage $V^s$ of the driving transistor in response to an opposite number$-V^s$ of the current source voltage $V^s$ of the driving transistor being greater than the threshold voltage $V^{th}$;

wherein the threshold voltage is a threshold voltage of the driving transistor while applying data voltage to the gate of the driving transistor.

2. The compensation method according to claim 1, wherein increasing the source voltage of the driving transistor comprises:

generating a target source voltage by adding a set value to a value of a current source voltage of the driving transistor; and inputting the target source voltage to a source of the driving transistor.

3. The compensation method according to claim 2, wherein the target source voltage is greater than or equal to 0V.

4. The compensation method according to claim 2, wherein the set value is a fixed value.

5. The compensation method according to claim 4, wherein the set value is an integral multiple of 0.5 or an integral multiple of 0.2.

6. The compensation method according to claim 2, wherein the set value is greater than an absolute value of a sum of the threshold voltage and the current source voltage.

7. The compensation method according to claim 1, wherein a light emitting unit in the pixel circuit which is connected to the driving transistor is controlled not to emit light during the acquisition of the threshold voltage of the driving transistor.

8. A compensation apparatus for a pixel circuit, comprising:

a sensing circuit configured to calculate a current threshold voltage $V^{th}$ of a driving transistor of the pixel circuit according to a current source voltage $V^s$ of the driving transistor and a data voltage applied to a gate of the driving transistor; and a controller configured to compare the current source voltage $V^s$ of the driving transistor with the current threshold voltage $V^{th}$, and adjust the current source voltage $V^s$ of the driving transistor according to a comparison result, wherein the current source voltage $V^s$ is a positive number, and the current threshold voltage $V^{th}$ is a negative number; and wherein the controller is configured to adjust the current source voltage $V^s$ of the driving transistor according to the comparison result by:

increasing the current source voltage $V^s$ of the driving transistor in response to an opposite value $-V^s$ of the current source voltage $V^s$ of the driving transistor being greater than the current threshold voltage $V^{th}$;

wherein the threshold voltage is a threshold voltage of the driving transistor while applying data voltage to the gate of the driving transistor.

9. The compensation apparatus according to claim 8, wherein the controller is configured to increase the source voltage of the driving transistor by:

generating a target source voltage by adding a set value to a value of a current source voltage of the driving transistor; and inputting the target source voltage to a source of the driving transistor.

10. The compensation apparatus according to claim 9, wherein the target source voltage is greater than or equal to 0V.

11. The compensation apparatus according to claim 9, wherein the set value is a fixed value.

12. The compensation apparatus according to claim 11, wherein the set value is an integral multiple of 0.5 or an integral multiple of 0.2.

13. The compensation apparatus according to claim 9, wherein the set value is greater than an absolute value of a sum of the threshold voltage and the current source voltage.

14. The compensation apparatus according to claim 8, wherein the sensing circuit is configured to control a light emitting unit in the pixel circuit which is connected to the driving transistor not to emit light during the acquisition of the threshold voltage of the driving transistor.

15. The compensation apparatus according to claim 8, wherein the sensing circuit comprises a sensing transistor and a sensing capacitor, wherein the sensing transistor has a gate connected to receive a control signal, a first electrode connected to a source of the driving transistor, and a second electrode connected to a first terminal of the sensing capacitor, and a second terminal of the sensing capacitor is grounded.

16. A display apparatus, comprising the compensation apparatus for the pixel driving circuit according to claim 8.

* * * * *